US008951008B2

(12) United States Patent
Cornelius et al.

(10) Patent No.: US 8,951,008 B2
(45) Date of Patent: Feb. 10, 2015

(54) COMPRESSOR BLADE AND PRODUCTION AND USE OF A COMPRESSOR BLADE

(75) Inventors: Christian Cornelius, Sprockhövel (DE); Bernhard Küsters, Kamp-Lintfort (DE); Stephan Mais, Berlin (DE); Andreas Peters, Ratingen (DE); Achim Schirrmacher, Recklinghausen (DE); Lutz Stephan, Berlin (DE); Bernd van den Toorn, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 2387 days.

(21) Appl. No.: 11/659,551

(22) PCT Filed: Jun. 20, 2005

(86) PCT No.: PCT/EP2005/052848
§ 371 (c)(1),
(2), (4) Date: Nov. 7, 2007

(87) PCT Pub. No.: WO2006/015899
PCT Pub. Date: Feb. 16, 2006

(65) Prior Publication Data

US 2011/0044800 A1 Feb. 24, 2011

(30) Foreign Application Priority Data

Aug. 6, 2004 (EP) ..... 04018728

(51) Int. Cl.
*F01D 5/20* (2006.01)
*B23P 15/04* (2006.01)
(Continued)

(52) U.S. Cl.
CPC ..... *F04D 29/164* (2013.01); *F01D 5/20* (2013.01); *F04D 29/324* (2013.01)
USPC ..... 415/171.1; 415/173.1; 415/173.4; 416/223 R; 416/228; 416/235; 29/889.7

(58) Field of Classification Search
USPC ..... 415/171.1, 173.1, 173.4; 416/223 R, 416/228, 235; 29/889.7
See application file for complete search history.

(56) References Cited

U.S. PATENT DOCUMENTS 3,854,842 A * 12/1974 Caudill ..... 415/116
4,390,320 A * 6/1983 Eiswerth ..... 416/97 R
(Continued)

FOREIGN PATENT DOCUMENTS

| | | |
|---|---|---|
| DE | 1 428 165 | 2/1969 |
| FR | 2.054.402 | 4/1971 |
| JP | 2000130102 A | 5/2000 |

*Primary Examiner* — Igor Kershteyn

(57) ABSTRACT

The invention relates to a compressor blade of a compressor which, along a main axis, comprises a blade base, a platform area and an adjacent blade profile having a profile tip. The blade profile is configured by a convex wall at the suction end and a concave wall at the pressure end opposite the wall at the suction end. These surfaces extend, with respect to a flow medium, from a leading edge to a trailing edge, a profile center line extending in the center between the two. A front face is arranged on the profile tip at an angle to the main axis, a sealing lip at least partially extending from the leading edge to the trailing edge and the blade profile including the sealing lip having a blade profile height extending in the direction of the main axis. In order to allow for an inexpensive compressor blade having improved aerodynamic properties and a modified sealing lip while having the same sealing properties, the height of the sealing lip is less than 2 percent of the height of the blade profile.

15 Claims, 3 Drawing Sheets

(51) Int. Cl.

| | |
|---|---|
| ***F01D 11/08*** | (2006.01) |
| ***F01D 5/12*** | (2006.01) |
| ***F04D 29/16*** | (2006.01) |
| ***F04D 29/32*** | (2006.01) |

(56) References Cited

U.S. PATENT DOCUMENTS 5,476,363 A * 12/1995 Freling et al. ..... 415/173.1
5,564,902 A * 10/1996 Tomita ..... 416/97 R
6,039,531 A * 3/2000 Suenaga et al. ..... 415/115
6,059,530 A * 5/2000 Lee ..... 416/97 R
6,086,328 A * 7/2000 Lee ..... 416/97 R
6,106,233 A * 8/2000 Walker et al. ..... 416/213 R
6,190,129 B1 * 2/2001 Mayer et al. ..... 416/97 R
6,206,642 B1 3/2001 Matheny et al.
6,672,829 B1 * 1/2004 Cherry et al. ..... 415/115

* cited by examiner

COMPRESSOR BLADE AND PRODUCTION AND USE OF A COMPRESSOR BLADE

CROSS REFERENCE TO RELATED APPLICATIONS

This application is the US National Stage of International Application No. PCT/EP2005/052848, filed Jun. 20, 2005 and claims the benefit thereof. The International Application claims the benefits of European application No. 04018728.8 filed Aug. 6, 2004, both of the applications are incorporated by reference herein in their entirety.

FIELD OF INVENTION

The invention relates to a compressor blade for a compressor, which blade, along a main axis, has a blade root, a platform section and a blade profile, with a blade tip, adjoining the platform section, which blade profile is formed by a convex suction side wall and a concave pressure side wall opposite the suction side wall, which walls, with regard to a flow medium, extend from a leading edge to a trailing edge, and between which a profile center line extends in the middle, wherein an end face, which is disposed transversely to the main axis, is located on the profile tip, upon which end face a sealing lip, which is formed in one piece with the blade profile, extends along the profile center line at least partially from the leading edge to the trailing edge, at a distance from the suction side wall and from the pressure side wall, and the blade profile, including the sealing lip, has a blade profile height which extends in the direction of the main axis.

BACKGROUND OF THE INVENTION

A turbine blade, with a sealing lip which is cast on the blade airfoil, is known from U.S. Pat. No. 6,039,531. The sealing lip extends in the middle between suction side and pressure side on the profile tip.

Furthermore, a compressor rotor blade, which on its free end of the blade profile has an end face upon which a lip-like rib extends in the region of the suction side of the blade profile from a leading edge to a trailing edge, is known from JP-A-2000130102. The rib of the compressor rotor blade serves as a sealing element during operation of the compressor in order to reduce the tip clearance losses in the compressor, which losses occur between the blade tip and the boundary of the compressor duct.

The production of such a sealing rib on the suction side of the blade with a feathered edge can be cost-intensive, especially in the case of blades which are sharply corrected in the tip region, i.e. blades which are especially sharply curved in the tip region, since the production or the contour milling, as the case may be, is carried out by a five-axis miller. After milling the suction side wall and the sealing lip geometry, the blade is ground manually on the suction side in order to achieve the necessary surface finish quality. This manual machining leads to frequent manufacturing errors with corresponding disadvantages, such as scrap or non-optimum contours, as the case may be.

SUMMARY OF INVENTION

It is the object of the invention, therefore, to disclose an aerodynamically improved compressor blade without reducing the sealing action of the sealing lip. Furthermore, it is the object of the invention to disclose a cost-effective method for producing such a compressor blade, and also a use of the latter.

The object which relates to the compressor blade is achieved by means of the features of the claims, the object which relates to the production is achieved by means of the features of the claims, and the object which relates to the use is achieved by means of the features of the claims.

The invention proposes that the height of the sealing lip is less than two percent of the height of the blade profile.

The invention starts from the knowledge that a sealing lip of a compressor blade according to the invention, is produced cost-effectively by means of a three-axis milling unit, although on account of the geometrically exacting, aerodynamic shape of the blade profile of the compressor blade, this is produced by means of a five-axis milling unit or by means of close-tolerance forging.

For production, therefore, a simpler production method and/or a machine, which is more cost-effective in use, can be used for it.

This is especially of advantage in the case of compressor blades which are comparatively sharply curved in the tip region.

Moreover, error-prone and cost-intensive manufacturing steps, such as a manual reworking, can be dispensed with, without replacement. The production process is curtailed. Furthermore, the omission of the manual reworking leads to a significantly higher process reliability.

The accuracy of the geometry of the sealing lip according to the invention can be also checked and inspected more simply than that of a sealing lip which is constructed parallel to the suction side. This leads to a further reduction of the production cost.

According to the invention, the height of the sealing lip is at most two percent of the height of the blade profile. Up to now, a sealing lip which was connected in one piece to the blade profile had a greater height for production engineering reasons.

Calculations show that the newly selected size of the sealing lip on the end face has no negative influence on the aerodynamic performance of the blade profile, on the contrary, the aerodynamically optimized, effective area of the blade profile is increased on account of the lower sealing lip, which, in the case of a compressor fitted with the compressor blade according to the invention, leads to improved aerodynamics, to smaller flow disturbances in the tip region of the blade profile, and altogether to an increased efficiency.

Advantageous developments are disclosed in the dependent claims.

In particular, if the sealing lip has a side face on the suction side and a side face on the pressure side, which side faces extend parallel to the main axis, these can be produced especially simply and, therefore, cost-effectively. Furthermore, it is advisable to manufacture the two side faces so that they also extend parallel to the profile center line. Consequently, the side faces of the sealing lip are not aerodynamically formed, i.e. not inclined to the main axis, like the contour of the side walls of the blade profile. Furthermore, the sealing lip reduces the tip clearance losses across the profile tip.

In an advantageous development, the side faces of the sealing lip are interconnected by means of a feathered surface, which feathered surface is disposed perpendicularly to the radius of the rotor of the compressor. Therefore, a cylindrical gap can be formed between casing or hub component parts, as the case may be, and the compressor blade, which reduces the clearance losses.

The compressor blade according to the invention can be advantageously used in the same way as a rotor blade as also a stator blade.

Especially preferred is the development in which at least one side face of the sealing lip is interconnected to the end face by a transition radius, the size of which is at most 25 percent of the height of the sealing lip. On account of the especially small transition radius, an exceptionally low sealing lip height can be achieved. The production of such a transition radius is carried out cost-effectively together with the sealing lip by means of a shank end milling cutter on a three-axis milling unit. However, hitherto sharply curved blade profiles with a sealing lip which was milled with a large transition radius, had a greater sealing lip height, especially in the center region between leading edge and trailing edge, than in the region of the leading edge and trailing edge, which up to now led to flow disturbances. This convex shape of the sealing lip or its height, as the case may be, can be avoided by significantly smaller transition radii.

BRIEF DESCRIPTION OF THE DRAWINGS

The invention is explained in detail with reference to a drawing. In the drawings.

DETAILED DESCRIPTION OF INVENTION

Figure 1:
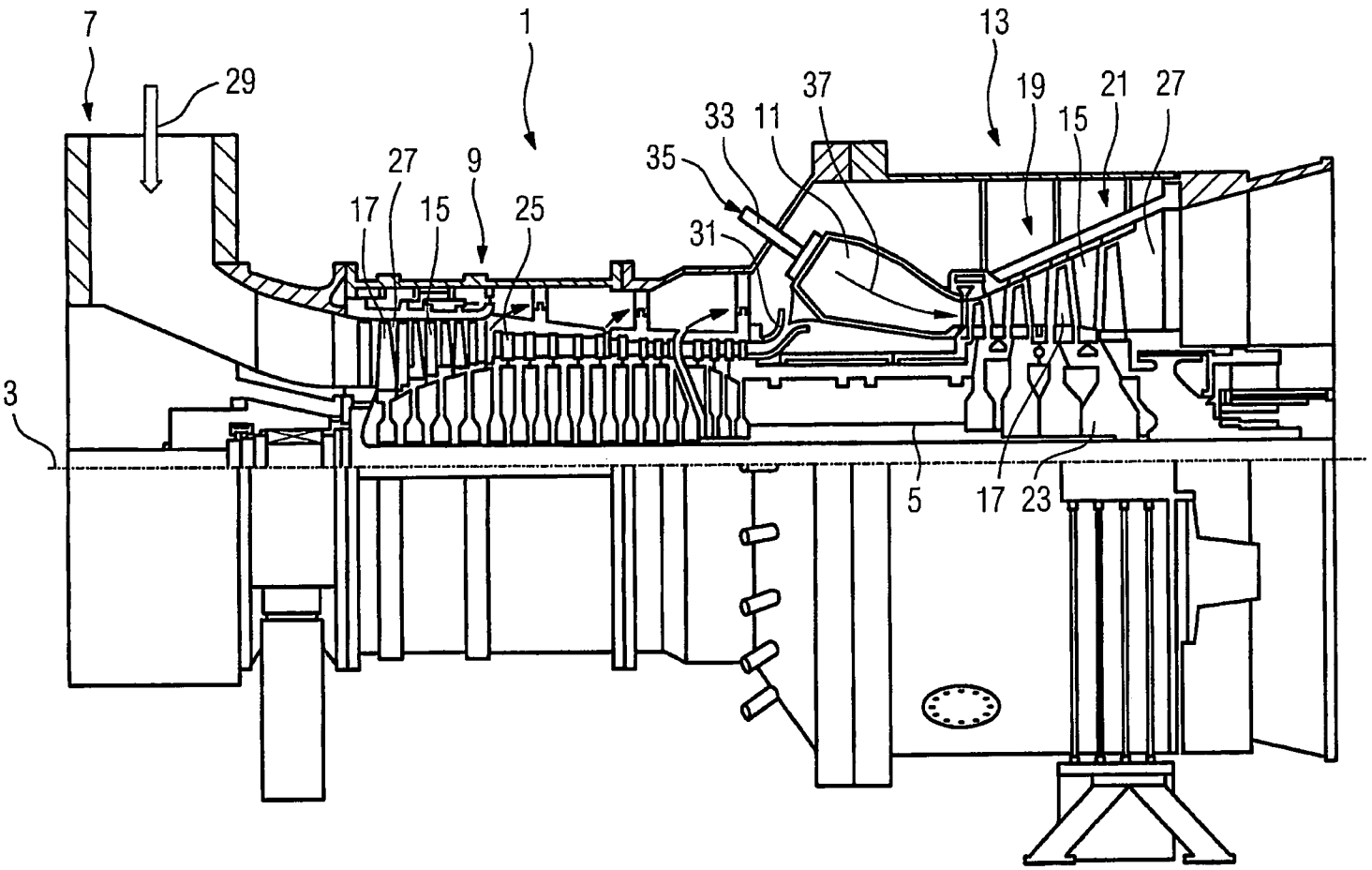
FIG. 1 shows a longitudinal partial section through a gas turbine with a compressor.

Compressors and gas turbines, and also their operating modes, are generally known. For this purpose, FIG. 1 shows a gas turbine 1 with a rotor 5 which is rotatably mounted around a rotational axis 3.

The gas turbine 1 has an intake duct 7, a compressor 9, a toroidal annular combustion chamber 11 and a turbine unit 13 along the rotational axis 3.

Stator blades 15 and rotor blades 17 are arranged in rings in each case both in the compressor 9 and in the turbine unit 13. In the compressor 9 in this case a stator blade ring 21 follows a rotor blade ring 19. The rotor blades 17 in this case are fastened on the rotor 5 by means of rotor discs 23, whereas the stator blades 15 are mounted on the casing 25 in a fixed manner.

Rings 21 of stator blades 15 are also arranged in the turbine unit 13, which stator blade rings are followed by a ring of rotor blades 17 in each case, viewed in the direction of the flow medium.

The respective blade profiles of the stator blades 15 and the rotor blades 17 in this case extend radially in an annular flow passage 27.

During operation of the gas turbine 1, air 29 from the compressor 9 is inducted through the intake duct 7 and compressed. At the outlet 31 of the compressor 9, the compressed air is guided to the burners 33 which are provided on a ring which lies on the annular combustion chamber 11.

In the burners, the compressed air 29 is mixed with a fuel 35, which mixture is combusted in the annular combustion chamber 11, forming a hot gas 37. The hot gas 37 then flows through the flow passage 27 of the turbine unit 13 past stator blades 15 and rotor blades 17. In doing so, the hot gas 37 is expanded on the rotor blades 17 of the turbine unit 13 with work output effect. As a result of this, the rotor 5 of the gas turbine 1 is set in a rotational movement which serves for drive of the compressor 9 and for drive of a driven machine, which is not shown.

Figure 2:
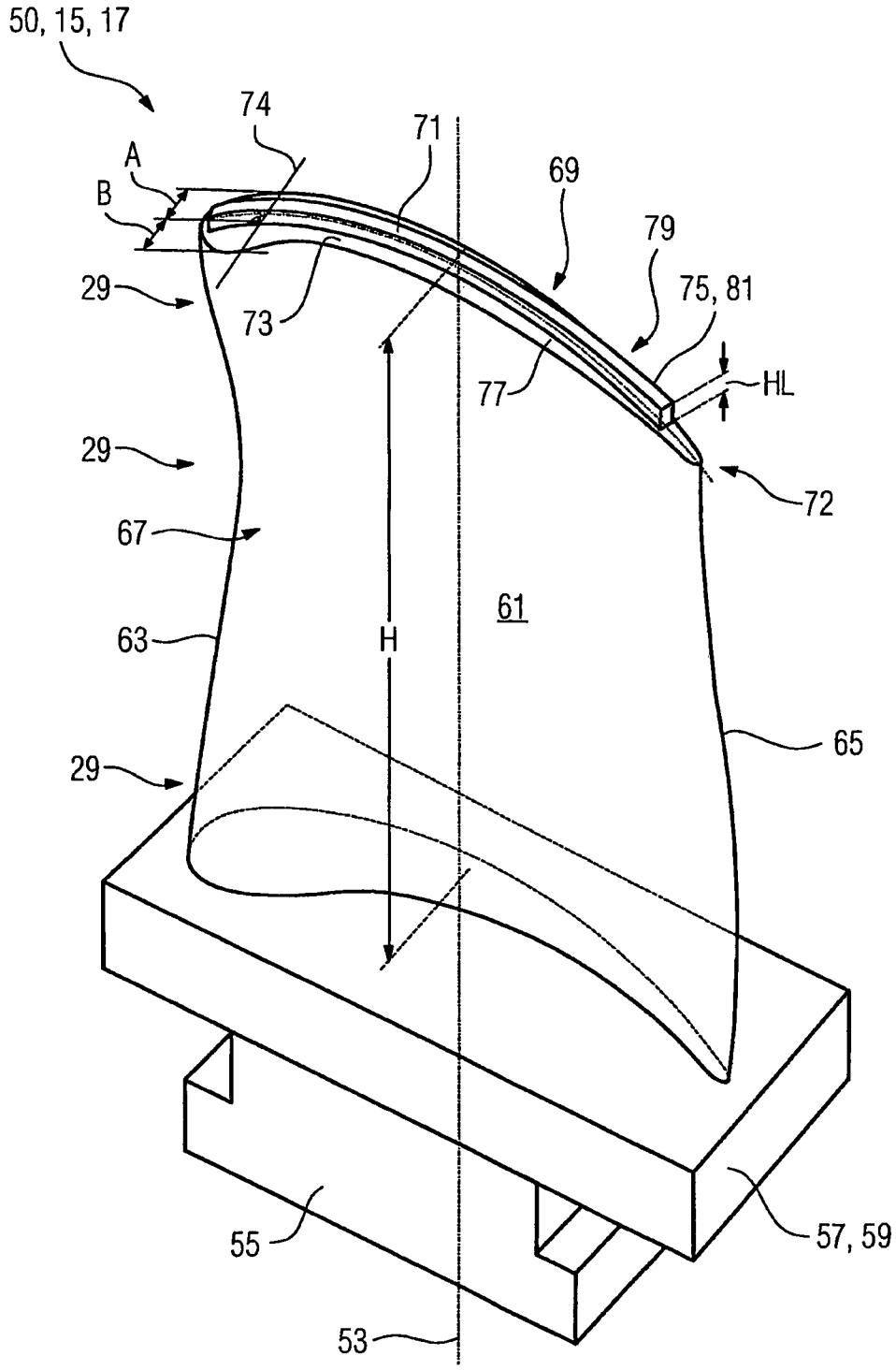
FIG. 2 shows a compressor blade according to the invention in a perspective view and FIG. 3 shows a detailed view of a feathered surface of a compressor blade.

FIG. 2 shows a compressor blade 50 in a perspective view. The compressor blade 50 has a blade root 55, a platform section 57 with a platform 59, and a blade profile 61 along a main axis 53. During operation of the compressor 9, the blade profile 61 is flow-washed by air 29 which flows onto the blade profile 61 at a leading edge 63 and flows off from a trailing edge 65. The blade profile 61 is formed by a pressure side wall 67 and by a suction side wall 69, and has a blade height H which extends in the direction of the main axis 53.

A profile center line 71 extends from the leading edge 63 to the trailing edge 65, which profile center line at each point of its progression has a perpendicular, which perpendicular 74 intersects both the suction side wall 69 and the pressure side wall 67. In this case, a first distance A between the intersection points of the perpendiculars 74 with the profile center line 71 and the pressure side wall 67 with the perpendiculars 74 in each case, is identical to a second distance B which exists between the intersection points of the profile center line 71 with the perpendiculars 74 and the suction side wall 69 with the perpendiculars 74.

In addition, the blade profile 61, on its profile tip 72 which faces away from the platform 59, has an end face 73 upon which a sealing lip 75 is located. The sealing lip 75 is narrower than the blade profile 61, extends from leading edge 63 to trailing edge 65, and extends along the profile center line 71, consequently in the space between the contour of the suction side wall 69 and the pressure side wall 67.

The sealing lip 75, also referred to as a feathered edge, has a first side surface 77 which faces the pressure side wall 67, and a second side face 79 which faces the suction side wall 69.

The curved side faces 77, 79 of the sealing lip 75 extend parallel to the main axis 53 and also parallel to the profile center line 71, whereas the suction side wall 69 of the blade profile 61 and also the pressure side wall 67 of the blade profile 61 extend in an inclined manner for aerodynamic reasons, i.e. extend at an angle to the main axis 53. Compared with a blade of the prior art, a simplified production of the sealing lip 75 can be achieved by this.

Moreover, the side faces 77, 79 of the sealing lip 75 are interconnected by means of a feathered surface 81, which feathered surface 81 is disposed perpendicularly to the radius of the rotor 5 of the compressor 9.

The sealing lip 75 has a height HL which is oriented parallel to the main axis 53, which height is measured between the end face 73 of the blade profile and the feathered surface 81 and is part of the blade profile height H.

Figure 3:
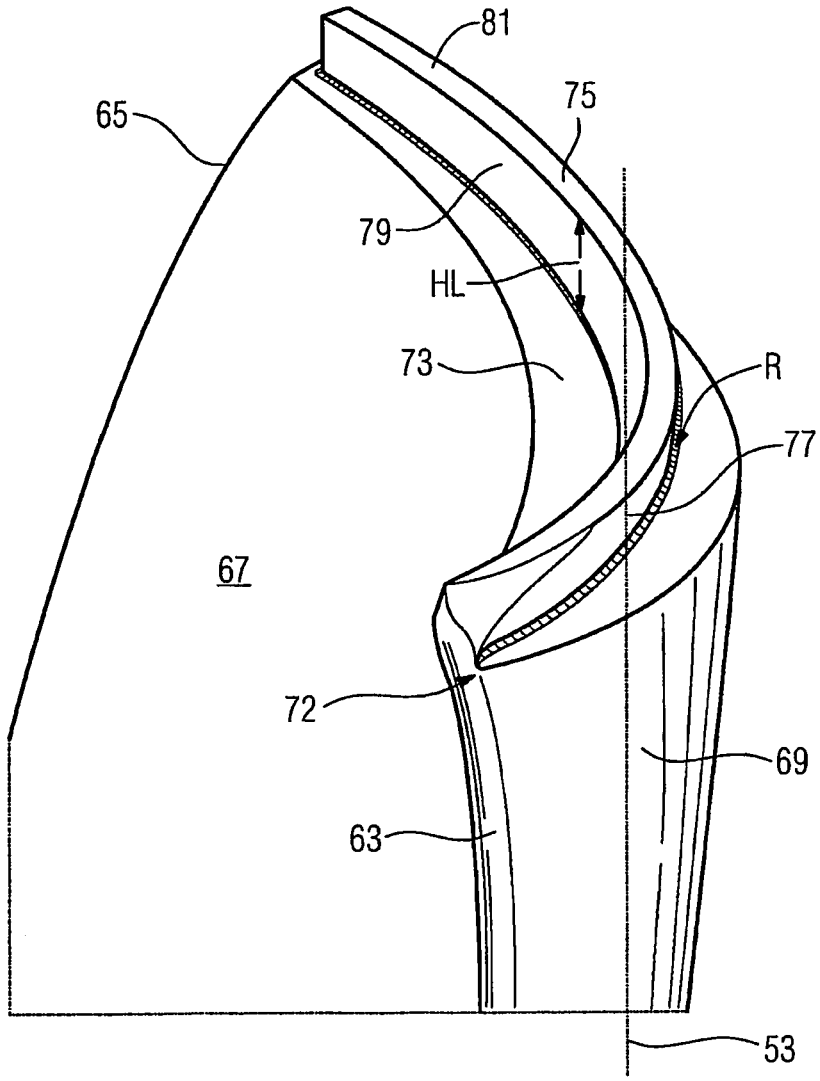

FIG. 3 shows a detailed view of a feathered edge according to the invention. In this case, it is clearly apparent that the sealing lip 75 extends centrally between the suction side wall 69 and the pressure side wall 67, from the leading edge 63 to the trailing edge 65, with side faces 77, 79 which are oriented parallel to the main axis 53 and to the profile center line 71.

The side faces 77, 79 merge into the end face 73 via a transition radius R which is advantageously at most 25 percent of the sealing lip height HL. As a result of this, an especially low sealing lip can be produced, the height HL of which is at most 2 percent of the blade airfoil height H.

By means of the new geometry and position of the sealing lip 75, error-prone and cost-intensive manufacturing steps are dispensed with. As a result of this, both the manufacturing costs and the scrap rate of the produced compressor blades 50 can be reduced. A worsening of the tip clearance losses through the radial gap between compressor blade 50 and inner casing does not occur in this case, just as little as flow losses on account of the insignificantly reduced, maximum possible aerodynamically effective profile face:

The invention claimed is:

1. A compressor blade for a compressor, comprising:

a blade root arranged along a main axis of the blade;

a platform section arranged adjacent to the blade root and along the main axis;

a blade profile adjoining the platform section having a profile tip and a profile height extending in the direction of the main axis, the blade profile extending from a leading edge with respect to a flow medium to a trailing edge between which a profile center line extends in the middle, and a convex suction side wall and a concave pressure side wall opposite the suction side wall, wherein an end face, which is disposed transversely to the main axis, is located on the profile tip; and a sealing lip arranged on the end face, the sealing lip being formed in one piece with the blade profile, extends along the profile center line at least partially from the leading edge to the trailing edge, at a distance from suction side wall and from pressure side wall, wherein the sealing lip has a sealing lip height that is less than two percent of the height of the blade profile.

2. The compressor blade as claimed in claim 1, wherein the sealing lip has a suction side face on the suction side and a pressure side face on the pressure side, which both side faces extend parallel to the main axis.

3. The compressor blade as claimed in claim 2, wherein the two side faces extend parallel to the profile center line.

4. The compressor blade as claimed in claim 2, wherein the side faces of the sealing lip are interconnected by a feathered surface disposed perpendicularly to the radius of the rotor of the compressor.

5. The compressor blade as claimed in claim 1, wherein one of the side faces of the sealing lip is interconnected to the end face by a radius that is at most 25 percent of the height of the sealing lip.

6. The compressor blade as claimed in claim 1, wherein the sealing lip is machined into the profile tip.

7. A method for producing a sealing lip of a compressor blade, comprising:

arranging a blade root along a main axis of the blade;

arranging a platform section adjacent to the blade root and along the main axis;

adjoining a blade profile to the platform section, the blade profile having a profile tip and a profile height extending in the direction of the main axis, the blade profile extending from a leading edge with respect to a flow medium to a trailing edge between which a profile center line extends in the middle, and a convex suction side wall and a concave pressure side wall opposite the suction side wall, wherein an end face, which is disposed transversely to the main axis, is located on the profile tip; and arranging a sealing lip on the end face, the sealing lip being formed in one piece with the blade profile, extends along the profile center line at least partially from the leading edge to the trailing edge, at a distance from suction side wall and from pressure side wall, wherein the sealing lip has a sealing lip height that is less than two percent of the height of the blade profile and the sealing lip is machined on a profile tip of a blade profile by a milling unit.

8. The method as claimed in claim 7, wherein the sealing lip is machined by a 3 axis milling unit.

9. The method as claimed in claim 7, wherein the compressor blade is milled or close-tolerance forged.

10. A gas turbine engine arranged along a rotational center axis, comprising:

a rotor arranged coaxial with the center axis;

an axial flow compressor section that compresses a flow medium, the compressor section having:

a plurality of rotor disk sections that collectively form a compressor rotor section, a plurality of compressor rotor blades arranged on the rotor disks, each rotor blades comprising:

a blade root arranged along a blade main axis, a platform section arranged adjacent to the blade root and along the main axis, a blade profile adjoining the platform section having a profile tip and a profile height extending in the direction of the main axis, the blade profile extending from a leading edge with respect to a flow direction of the flow medium to a trailing edge between which a profile center line extends in the middle, and a convex suction side wall and a concave pressure side wall opposite the suction side wall, wherein an end face, which is disposed transversely to the main axis, is located on the profile tip, and a sealing lip arranged on the end face, the sealing lip being formed in one piece with the blade profile, extending along the profile center line at least partially from the leading edge to the trailing edge, at a distance from the suction side and the pressure side walls, wherein the sealing lip has a sealing lip height that is less than two percent of the height of the blade profile, a combustor section that receives the compressed flow medium and produces a hot flow medium; and a turbine section that expands the hot flow medium to extract mechanical energy.

11. The gas turbine engine as claimed in claim 10, wherein the sealing lip has a suction side face on the suction side and a pressure side face on the pressure side, which both side faces extend parallel to the main axis.

12. The gas turbine engine as claimed in claim 11, wherein the two side faces extend parallel to the profile center line.

13. The gas turbine engine as claimed in claim 11, wherein the side faces of the sealing lip are interconnected by a feathered surface disposed perpendicularly to the radius of the rotor of the compressor.

14. The gas turbine engine as claimed in claim 10, wherein one of the side faces of the sealing lip is interconnected to the end face by a radius that is at most 25 percent of the height of the sealing lip.

15. The gas turbine engine as claimed in claim 14, wherein the engine is a stationary, industrial gas turbine engine.

* * * * *